United States Patent [19]

Funaro

[11] 4,141,468

[45] Feb. 27, 1979

[54] FLEXIBLE COMPOSITE CONTAINER FOR DISPENSING MATERIALS IN PASTE FORM

[75] Inventor: Giampaolo Funaro, Florence, Italy

[73] Assignee: Primark AG, Coira, Switzerland

[21] Appl. No.: 847,631

[22] Filed: Nov. 1, 1977

Related U.S. Application Data

[63] Continuation of Ser. No. 673,573, Apr. 5, 1976, abandoned.

[30] Foreign Application Priority Data

Apr. 18, 1975 [IT] Italy ..... 11626 B/75
Jul. 25, 1975 [IT] Italy ..... 11729 B/75

[51] Int. Cl.[2] ..... B65D 35/08

[52] U.S. Cl. ..... 222/105; 206/219; 222/205; 222/541

[58] Field of Search ..... 222/92, 103, 105, 207, 222/211-213, 494, 541, 542, 95, 106, 107, 183, 184, 205, 210, 214, 215, 540, 81; 206/219, 221, 515, 519, 568

[56] References Cited

U.S. PATENT DOCUMENTS

| | | | |
|---|---|---|---|
| 1,982,512 | 11/1934 | Graham | 222/205 |
| 2,208,744 | 7/1940 | Bergerioux | 222/92 X |
| 2,493,633 | 1/1950 | Mart | 206/519 |
| 2,518,751 | 8/1950 | Carlton | 222/205 X |
| 2,591,354 | 4/1952 | Harris | 222/92 |
| 3,195,785 | 7/1965 | Oram | 222/212 X |
| 3,199,749 | 8/1965 | Driscoll | 222/541 X |
| 3,908,857 | 9/1975 | Chiappe | 222/541 X |
| 4,006,820 | 2/1977 | Smith | 206/219 |

*Primary Examiner*—Allen N. Knowles
*Assistant Examiner*—Fred A. Silverberg
*Attorney, Agent, or Firm*—Ladas, Parry, Von Gehr, Goldsmith & Deschamps

[57] ABSTRACT

The invention relates to a composite dispenser for materials in paste form which are intended to be admixed with a diluent prior to use, comprising a flexible container consisting of a lower material-containing section and of an upper section forming an open receptacle when separated from the lower section by a perforable wall whereby, after perforation, application of pressure upon the lower section will cause a controlled quantity of the material contained therein to be dispensed through the perforation into the upper receptacle for admixture in situ with a suitable diluent.

4 Claims, 3 Drawing Figures

FLEXIBLE COMPOSITE CONTAINER FOR DISPENSING MATERIALS IN PASTE FORM

This is a continuation, of application ser. no. 673,573 filed Apr. 5, 1976 now abandoned.

The present invention relates to a composite dispenser for materials in paste form, such as concentrated water-colors or oil-colors, which are intended to be admixed with a suitable diluent prior to use.

As is well known, water-colors and oil-colors are usually sold in concentrated form and small quantities are taken from the container for use and admixed with a suitable solvent. The containers commonly used are plastic or metallic squeeze tubes.

The problem with such containers is that, since the actual admixture must take place in a separate vessel, numerous vessels must be acquired, one for each color used. Furthermore, this operation results in a waste of material due to the inability of the user to control with accuracy the amount of concentrate dispensed.

The present invention relates to a composite dispenser for materials in paste form which permit an extremely accurate dispensing of said material into an open cup which forms an integral part of the dispenser and in which the admixture with the suitable diluent can be effected.

The dispenser of the invention, once assembled, consists of a flexible container for the paste material and of a section disposed above said container in a manner that the means for closure for the container acts also as the bottom of the upper section. The dispensing of the paste material from the container to the upper section, which forms an open cup, is obtained by applying pressure on the container wall thus forcing the paste material therefrom through a suitable opening in the closure means, said opening being obtained as hereinafter described.

According to one embodiment of the invention, the opening is obtained by providing a means of closure which is apt to be easily perforated at a predetermined point. According to another embodiment, the closure is already preformed with a suitable opening therein, said opening being maintained close prior to use by a removable adhesive tab. According to a further embodiment, the closure is provided with a hollow upwardly extending section which can be cut prior to use to obtain the desired opening.

Figure 1:
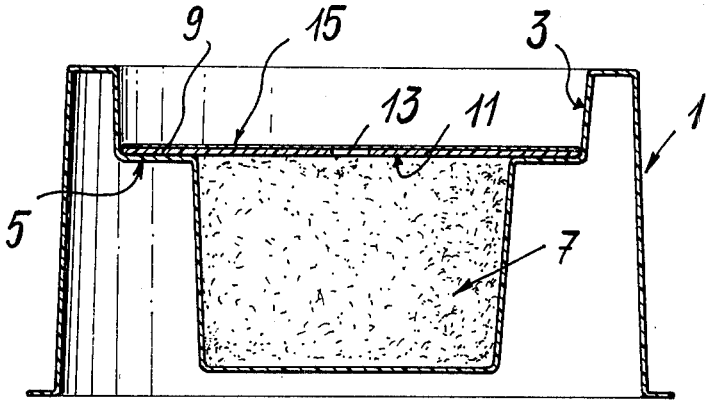
FIG. 1 is a sectional view of the composite dispenser of the invention shown fully assembled.

The main body of the present dispenser has externally an approximately cylindrical or slightly frusto-conical shape. Said body is formed from flexible, easily deformable material of suitable thicknesses, such as plastic, plastified material or the like. On the upper part of the said body the external wall 1 is being inwardly and downwardly for a depth of few millimeters so as to form the sides 3 of a shallow cup; said wall then continues without interruption to form a flat annular zone 5. At the center of said annular zone there is formed a central cavity 7 which extends downwardly within the interior of the external wall 1. This cavity constitutes the actual material-containing section of the dispenser and can be of a cylindrical, hemispherical or other suitable shape. The upper or closure part of the container consists of a disk 9 of a diameter slightly smaller than the internal diameter of the sides 3 of the cup; the disk is formed of rigid or semirigid plastic material of the same chemical composition than that of the main body, or of a plastified heat-sealable cardboard, or of a heat-sealable aluminium, or of any other material which can be sealed by heat or by chemical or physical means to the flat annular zone 5 of the main body.

To utilize the dispenser of the present invention, one first fills the central cavity 7 with the desired material and then seals said cavity be means of disk 9, along the flat annular zone 5. The disk thus effects an air-tight seal for the container, the contents of which remain protected from drying, contamination and the like.

In the embodiment shown in FIG. 1, disk 9 is composed of two layers of equal diameters, a first layer 11 having preformed therein an opening 13 of suitable size and shape and a second layer 15 integral therewith, thinner than said first layer and without any openings.

To use the product, it is sufficient to pierce the second layer 15 in correspondence to opening 13 by means of a suitable object, such as a pencil point. To dispense the material, pressure is applied on the lower section of container 7 forcing the desired quantity of material through opening 13 into the cup defined by the sides 3 and the disk 9. The paste material can then be diluted or otherwise treated.

After use, the treated material remaining in the cup, particularly when such material is concentrated oil-paint or water-paint, tends to dry thus forming a film which recloses the opening and effectively prevents air from coming into contact with the material still remaining in the container, thus preventing it from drying and so protecting it. If the materials being dispensed do not posses such filmforming characteristics, a suitable plug may be provided to close the opening.

Figure 2:
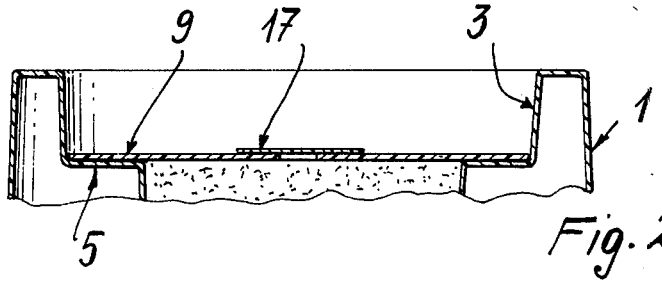
FIGS. 2 and 3 are sectional views of other embodiments of the means of closings operable in the present invention.
Figure 3:
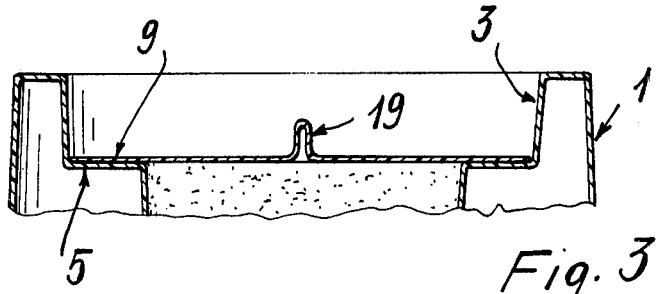

FIGS. 2 and 3 show the other embodiments of the means of closing the container contemplated by the present invention.

In FIG. 2, disk 9 is provided with a removable adhesive tab 17 which serves to close opening 13 preformed in said disk.

In FIG. 3, disk 9 is provided with a hollow upwardly-extending section 19 which can be cut prior to use to obtain the desired opening.

It is noted that, for aesthetic purposes, particularly where the dispenser is used to market paints, the disk can be formed totally or partially of a transparent material. This allows the prospective purchaser to view the precise color of the contents, adding marketing value to the present device.

What is claimed is:

1. A composite container-dispenser for holding small quantities of coloring paste adapted to be diluted prior to use comprising in combination:

a central paste container made from deformable material;

a flat annular zone surrounding an opening of the central container;

cylindrical sides contiguous with said annular zone forming a shallow cup;

a disk having a diameter slightly smaller than the internal diameter of the cup adapted to form an air-tight seal across the opening of the central container and prevent the paste contained therein from drying;

the disk having an opening means to allow a desired quantity of paste to be squeezed out of the central container into the area of the shallow cup so that the paste can be diluted in said cup; the material remaining in the cup area after use being adapted to form a film which re-closes the preformed opening and prevents air from coming into contact with the paste material remaining in the central container;

and a frusto-conical main body integrally formed with said cylindrical sides.

2. The composite container-dispenser as claimed in claim 1, wherein the disk is formed of two layers of equal diameter, the opening means comprises a preformed opening in a first layer and a second upper layer without an opening.

3. The composite container-dispenser as claimed in claim 1, wherein the opening means comprises a small preformed opening in the disk which is closed with a removable adhesive tab.

4. The composite container-dispenser as claimed in claim 1, wherein the opening means comprises a hollow upwardly-extending integral portion in the disk which can be cut to dispense the paste.

* * * * *